United States Patent [19]

Vallejos

[11] 4,119,077

[45] Oct. 10, 1978

[54] ROTARY VALVE SYSTEM FOR MOTORS AND THE LIKE HAVING IMPROVED SEALING MEANS

[75] Inventor: Tony E. Vallejos, Paramount, Calif.

[73] Assignee: Alto Automotive, Inc., Deerfield, Ill.

[21] Appl. No.: 801,634

[22] Filed: May 31, 1977

Related U.S. Application Data

[63] Continuation-in-part of Ser. No. 653,195, Jan. 28, 1976, Pat. No. 4,098,238.

[51] Int. Cl.[2] ..... F01L 3/00; F01L 1/28

[52] U.S. Cl. ..... 123/188 B; 123/79 R; 123/81 B; 123/190 R; 123/190 B

[58] Field of Search ..... 123/79 R, 79 A, 81 R, 123/81 B, 81 C, 90.24, 90.26, 188 B, 188 C, 190 R, 190 B, 190 BB, 190 BD, 190 E, 80 R, 80 BA; 137/624.13, 624.15, 624.17; 251/251

[56] References Cited

U.S. PATENT DOCUMENTS

| | | | |
|---|---|---|---|
| 1,273,002 | 7/1918 | Samuels | 123/188 B |
| 1,476,359 | 12/1923 | Ford | 123/79 |
| 1,492,587 | 5/1924 | Toth | 123/188 B |
| 1,902,130 | 3/1933 | Keister | 123/79 |
| 1,924,188 | 8/1933 | Hall | 123/190 BB |
| 2,874,686 | 2/1959 | Carey, Jr. | 123/81 |

FOREIGN PATENT DOCUMENTS

| | | | |
|---|---|---|---|
| 246,353 | 3/1910 | Fed. Rep. of Germany | 123/188 |
| 371,496 | 3/1923 | Fed. Rep. of Germany | 123/188 B |
| 443,757 | 10/1912 | France | 123/188 B |
| 246,287 | 1/1926 | United Kingdom | 123/188 B |

*Primary Examiner*—Charles J. Myhre
*Assistant Examiner*—David D. Reynolds
*Attorney, Agent, or Firm*—Garrettson Ellis

[57] ABSTRACT

A rotary valve system for a motor and the like includes a flow conduit and rotary valve means interposed in the flow conduit. Intermittent sealing means are provided for preventing flow through the flow conduit, comprising a sealing surface intermittently positionable in stationary, sealing relationship across the conduit. Means are also provided for moving the sealing surface into such stationary sealing relationship with the flow conduit, and out of sealing relationship with the flow conduit in a manner correlating with the operation of the rotary valve means, to facilitate sealing as the valve operates.

25 Claims, 21 Drawing Figures

FIG. 5
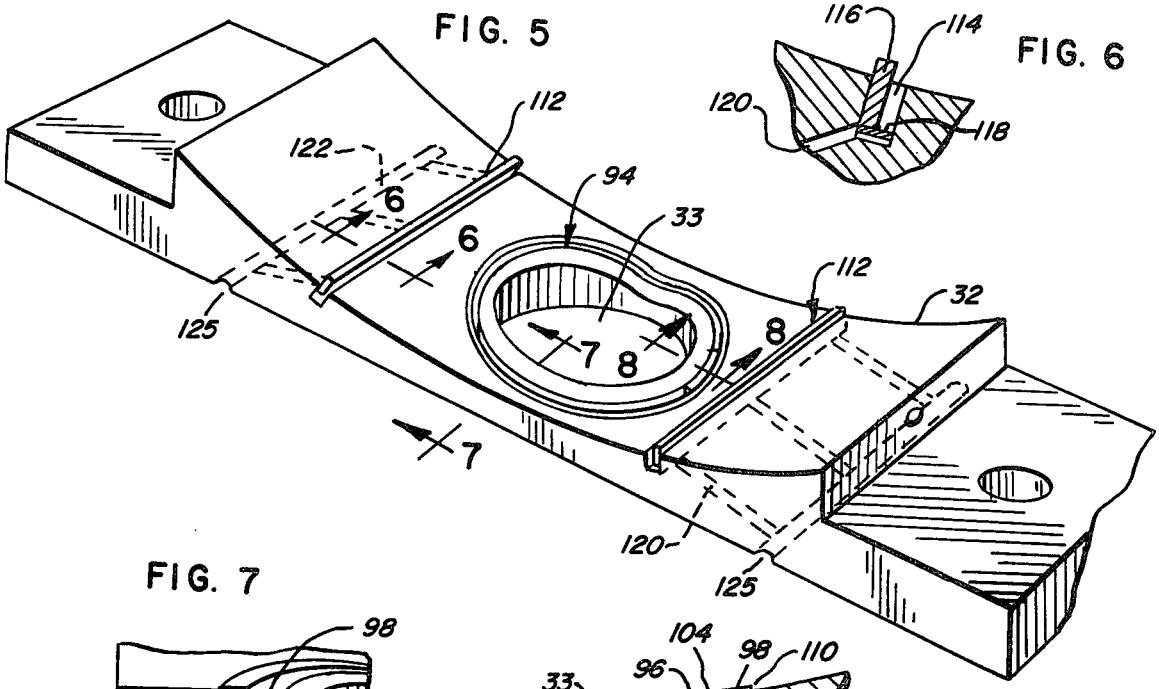
FIG. 6
FIG. 7
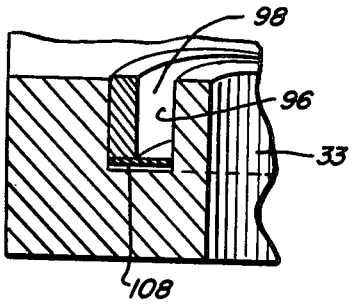
FIG. 8
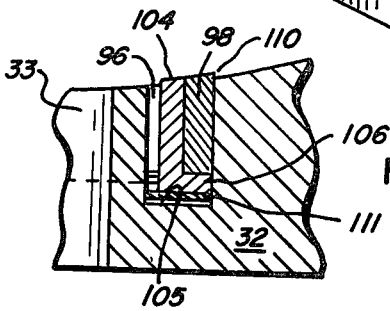
FIG. 9
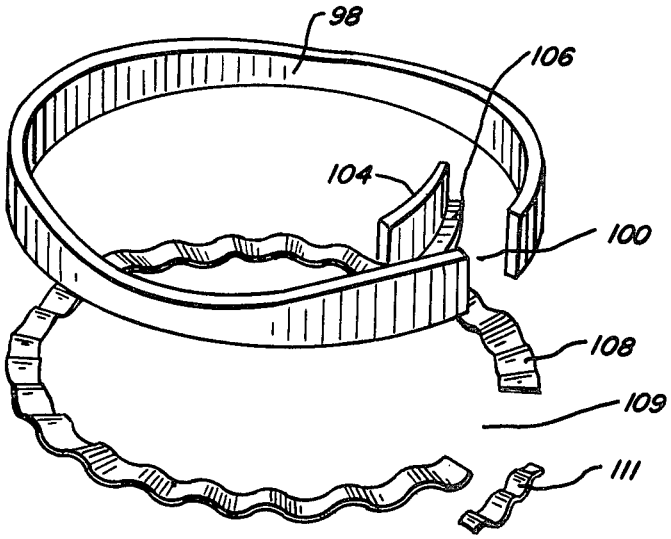

FIG. 11
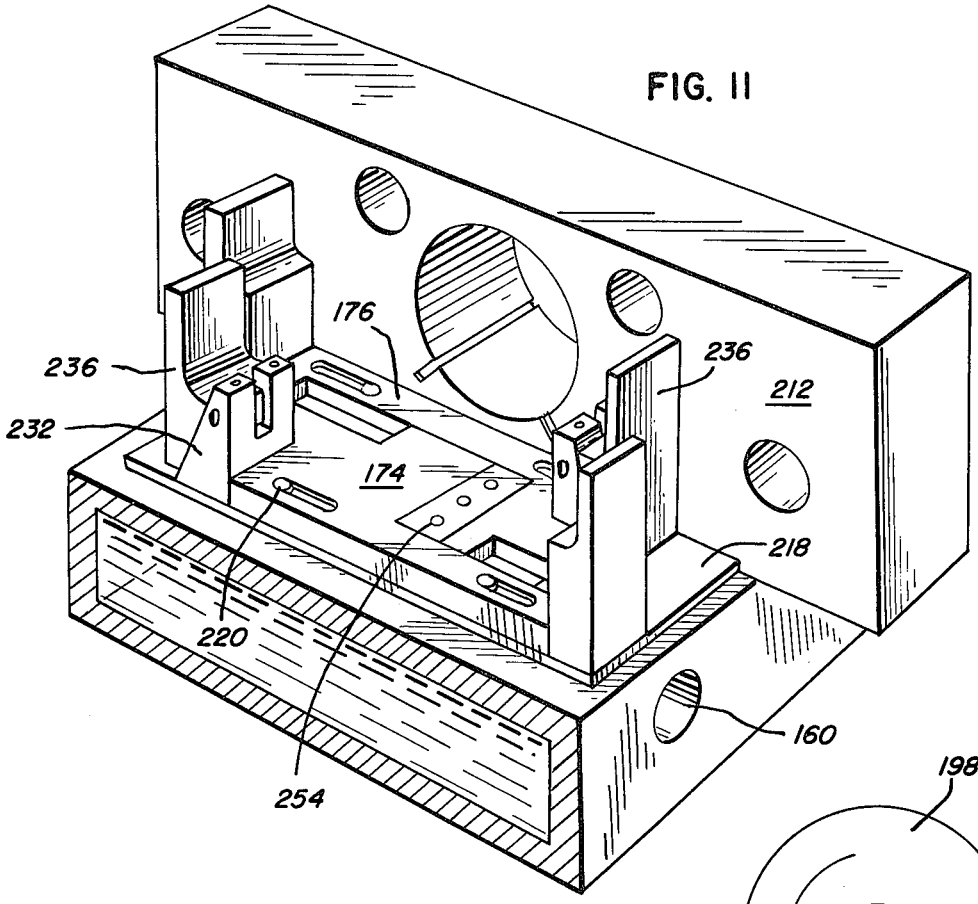
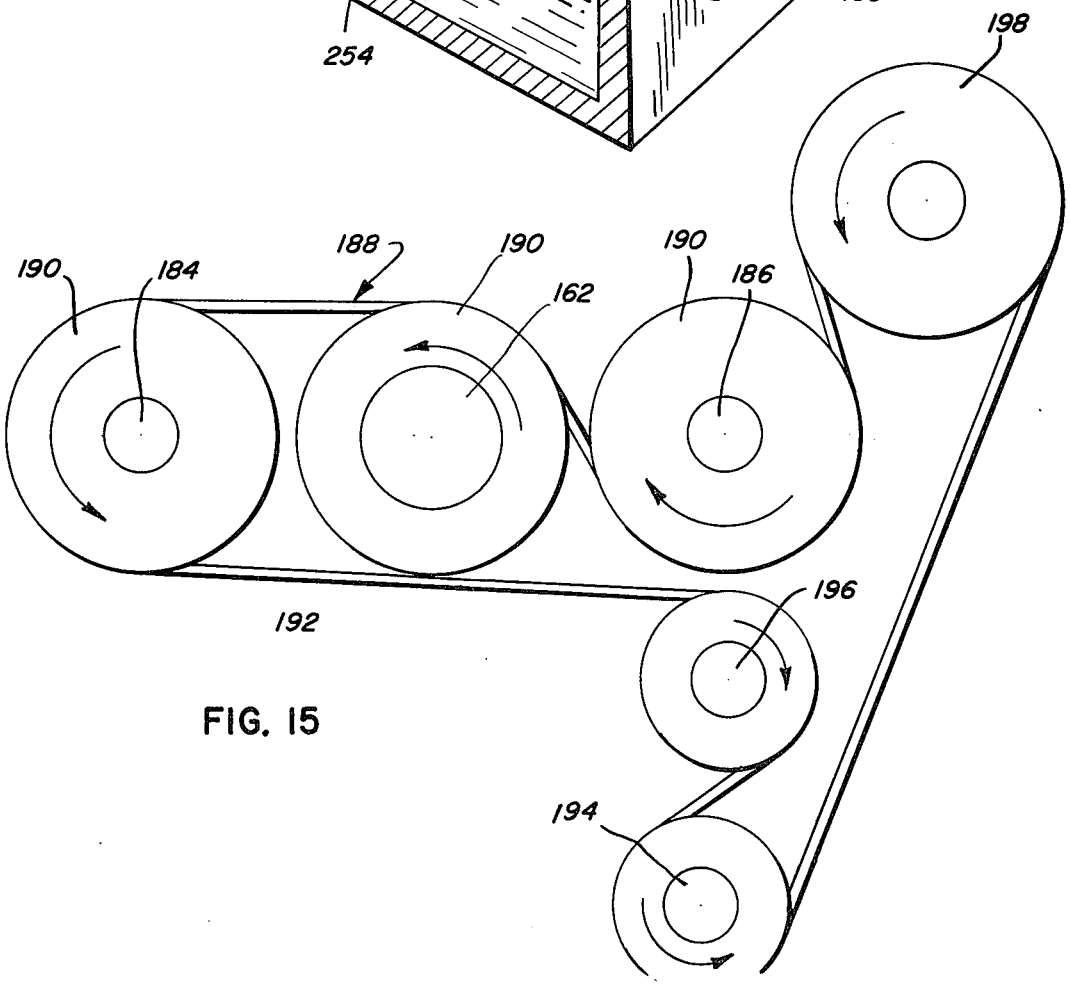
FIG. 15

ROTARY VALVE SYSTEM FOR MOTORS AND THE LIKE HAVING IMPROVED SEALING MEANS

CROSS-REFERENCE TO RELATED APPLICATION

This application is a continuation-in-part of the U.S. application Ser. No. 653,195, now U.S. Pat. No. 4,098,238 filed Jan. 28, 1976.

BACKGROUND OF THE INVENTION

In the search for improvements in the operation of internal combustion engines, many attempts have been made to replace the conventional poppet valves of an engine cylinder with rotary valves. One such attempt is illustrated in U.S. Pat. No. 1,692,396. Another, more recent, engine design utilizing rotary valves is shown in an article by David Scott, relating to a cruciform engine, beginning on page 78 of the July, 1975 issue of *Popular Science.*

These, however, are mrely exemplary of the hundreds of patents and articles relating to the use of rotary valves in engines.

Rotary valves have been considered to have significant advantages over the conventional poppet valves for an engine cylinder because they can operate more rapidly, reducing the problem which can be found in high speed poppet valve engines, in which the poppet valve actually can tend to run behind the remainder of the engine, the valve return springs being inadequate to cause them to keep up with the operation of the engine at an extremely high RPM rate.

Also, the maximum compression of an engine must be limited so that the piston at top dead center position does not strike the open poppet valve. If one desires to increase the compression beyond such a level, it would be desirable to use rotary valves.

Furthermore, in many designs of rotary valves, a single port, functioning as both fuel inlet and exhaust gas outlet, can be provided to the combustion cylinder. This reduces the extremely high temperatures of the exhaust valve in a conventional poppet valve engine, reducing the possibility of preignition upon compression of the fuel mixture prior to firing.

Rotary valves also require less energy to operate than poppet valves, increasing the energy output of the engine.

However, despite the various significant potential advantages that a rotary valve system can be expected to have in an internal combustion engine, they have not come into commercial use, largely because rotary valves tend to leak if they are loose enough to permit free rotation, but they may seize if they are tight enought to contain the combustive pressures generated in the combustion chamber. To date, there appears to have been proposed no effective way to seal rotary valves in such a manner that the leakage of fuel vapors and exhaust gas is prevented to such a degree over the long term that the commercialization of a motor using a rotary valve system would be feasible.

In accordance with this invention, a rotary valve system having an auxiliary sealing mechanism is provided, particularly for sealing of the combustion chamber during compression and ignition states of motor operation.

As a result, the rotary valve itself no longer has to perform a significant sealing role against the pressures of the combustion chamber, but may simply work as a metering device for fuel and exhaust gas at relatively ambient pressures. Thus, the problem of rotary valve seizing can be eliminated, since the critical sealing functions are provided by other means.

Thus, the many advantages of the rotary valve may be utilized in motors designed in accordance with this invention.

DESCRIPTION OF THE INVENTION

In this invention, a rotary valve system for a motor and the like is provided, including a flow conduit for fuel and exhaust, and rotary valve means interposed in the flow conduit.

In accordance with this invention, intermittent sealing means are provided for preventing flow through the flow conduit. These intermittent sealing means comprise a sealing surface intermittently positionable in stationary, sealing relationship across the conduit. Also, means are provided for moving the sealing surface into the aforesaid stationary, sealing relationship with the flow conduit, and out of such sealing relationship with the flow conduit, in a manner correlating with the operation of the rotary valve means, to provide intermittent sealing at appropriate moments as the valve operates.

Accordingly, when the rotary valve utilized in this present invention occupies a position to block the flow of material to or from the combustion chamber, the intermittent sealing means can be adapted to occupy its stationary, sealing relationship across the flow conduit, typically at the entrance to the combustion chamber, to seal the chamber. When the rotary valve means is in open position, to either inject fuel vapors into the combustion chamber or to permit the withdrawal of exhaust gas, the intermittent sealing means is adapted to be out of sealing relationship with the conduit, to permit communication through the rotary valve into or out of the combustion chamber. Thus, as the valve rotates to alternatingly open and close the fuel inlet and exhaust gas outlet, the intermittent sealing means can also be moved back and forth into corresponding open and sealing positions as the function of the motor dictates.

One particular advantage of this present invention lies in the fact that the intermittent sealing means provides a stationary seal of the combustion chamber, while the rotary valve may at the same time continue in constant rotary motion during the operation of the engine. A stationary seal between unmoving surfaces results in much less wear of the sealing parts, when compared with a seal involving relatively moving surfaces. Also, a stationary seal can provide more effective high pressure sealing. This results in greater sealing reliability and life of the sealing parts.

Typically, several rotary valve systems as described above may be positioned in linear array, and operated by a common control shaft means, which may particularly be a camshaft as described below. Also, the several rotary valves in this linear array of rotary valve systems may all be defined by a single, rotatable shaft member, for simplicity of construction of motors in accordance with this invention, and for permanently determining the proper operating sequence of the various valve systems.

If desired, this invention can be used in conjunction with motors having separate inlet and outlet valves, as well as in other high pressure fluid handling apparatus besides motors. In the drawings, FIG. 1 is an elevational view, with some parts broken away, of a motor made in accordance with this invention, showing in particular pistons and cylinders, and portions of the valving and sealing system of this invention.

FIG. 2 is a vertical sectional view taken through a valve assembly of FIG. 1, but also including additional structure in its lower portion not illustrated in FIG. 1.

FIG. 2*a* is a detailed sectional view of portions of the structure as shown in FIG. 2, but in a different operational position.

FIG. 5 is a perspective view of a valve plate bed utilized in the preceeding Figures.

FIG. 6 is a sectional view taken along line 6—6 of FIG. 5.

FIG. 7 is a sectional view taken along line 7—7 of FIG. 5.

FIG. 8 is a sectional view taken along line 8—8 of FIG. 5.

FIG. 9 is a perspective, exploded view of certain parts otherwise illustrated in FIGS. 5, 7, and 8.

FIG. 11 is a fragmentary perspective view of a portion of the motor of FIG. 10 with valve plates shown in a closed, rather than in an open position.

FIG. 15 is an elevational view of the means for connecting the various rotating parts of the engine of FIGS. 10 through 14 to rotate in synchronous manner.

Figure 1:
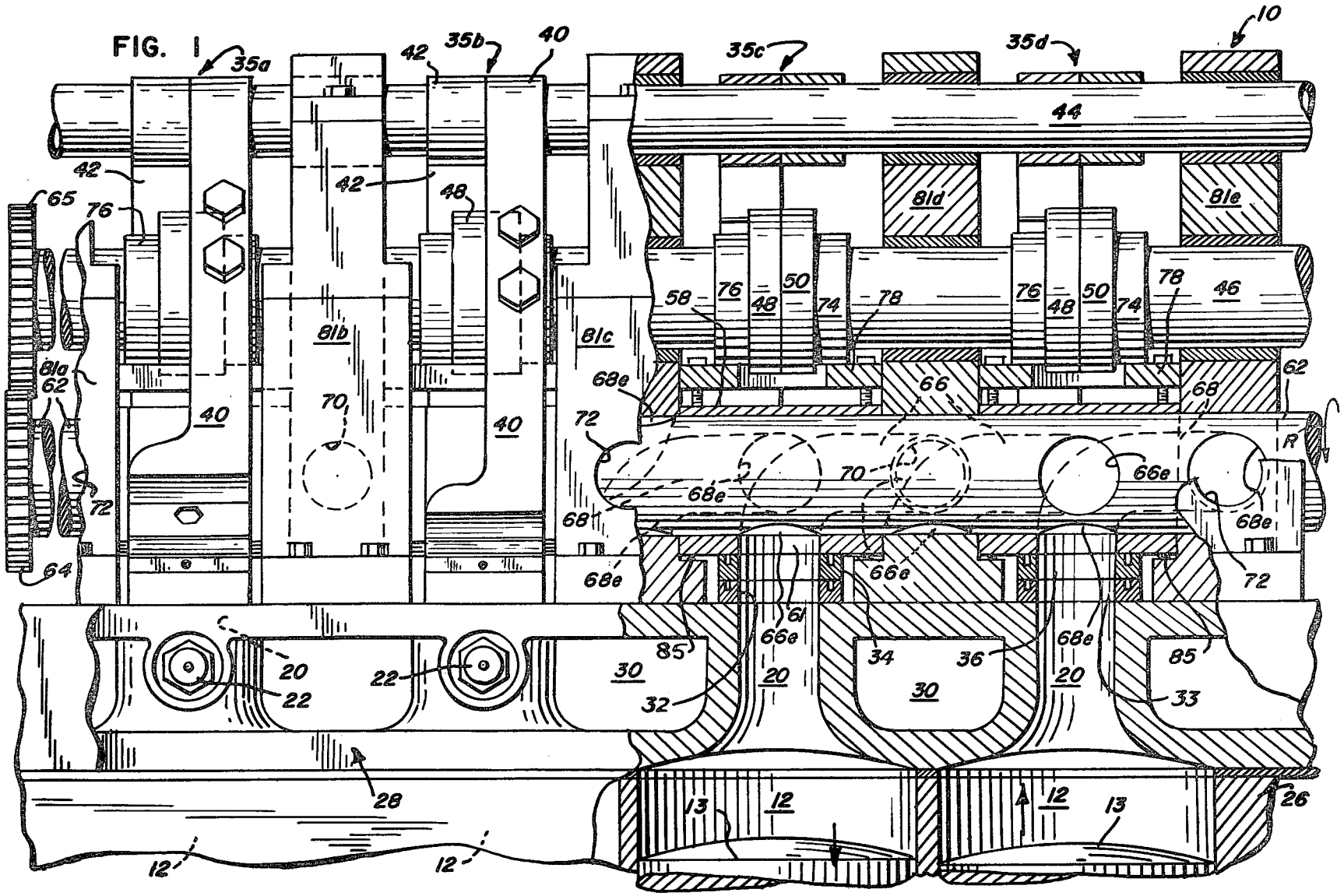

Referring to the drawings, a portion of a motor 10 is illustrated. Motor 10 may be of entirely conventional design, except as otherwise indicated. The particular embodiment shown comprises an internal combustion engine having four reciprocating piston and cylinder assemblies or combustion chambers 12, which may be of conventional construction. The piston and cylinder assemblies include a reciprocating piston 13 which may be connected to a crankshaft 15 in a usual manner. However, while the invention of this application can be used with conventional piston, cylinder, and crankshaft assemblies, it is specifically contemplated that the invention of this application can be used in conjunction with a piston, cylinder and crankshaft arrangement similar to that illustrated in U.S. Pat. No. 3,985,114 in order to achieve the advantages of this present invention in conjunction with the advantages of the invention described in that application.

The invention of this application can be used with diesel, two-cycle, four-cycle engines, and the like, but the drawings illustrate, for exemplary purposes, a four-cycle engine.

Each piston and cylinder assembly includes a neck portion 20 of the cylinder, having an open top, with a spark plug 22 being transversely mounted in each neck portion 20.

This particular shape of combustion chamber can provide the advantages of a stratified charge arrangement, since fuel vapor will tend to be concentrated in the upper portion of neck portion 20 of the combustion chamber. This permits operation of the engine with a very lean fuel mixture. Also, it is believed that this particular shape can tend to suppress knock or preignition.

Piston and cylinder assemblies 12 can be defined by retainer 26, neck portions 20 being defined by a block 28, which may contain flow channels 30 defined through it. Channels 30 permit the flow of liquid coolant, to reduce the peak combustion temperatures of the combustion chamber, and accordingly to reduce the possibility of knocking as well as to reduce the generation of nitrogen oxide pollutants.

To define each valve assembly 35, bed 32, having aperture 33, is affixed to the top of block 28 in a position to permit moveable valve plate 34 to be in sliding contact with bed 32. Valve plate 34 and bed 32 define curved, matching, facing surfaces to permit valve plate 34 to slidingly reciprocate back and forth on bed 32 with rocking motion, as shown in FIG. 2.

Figure 2:
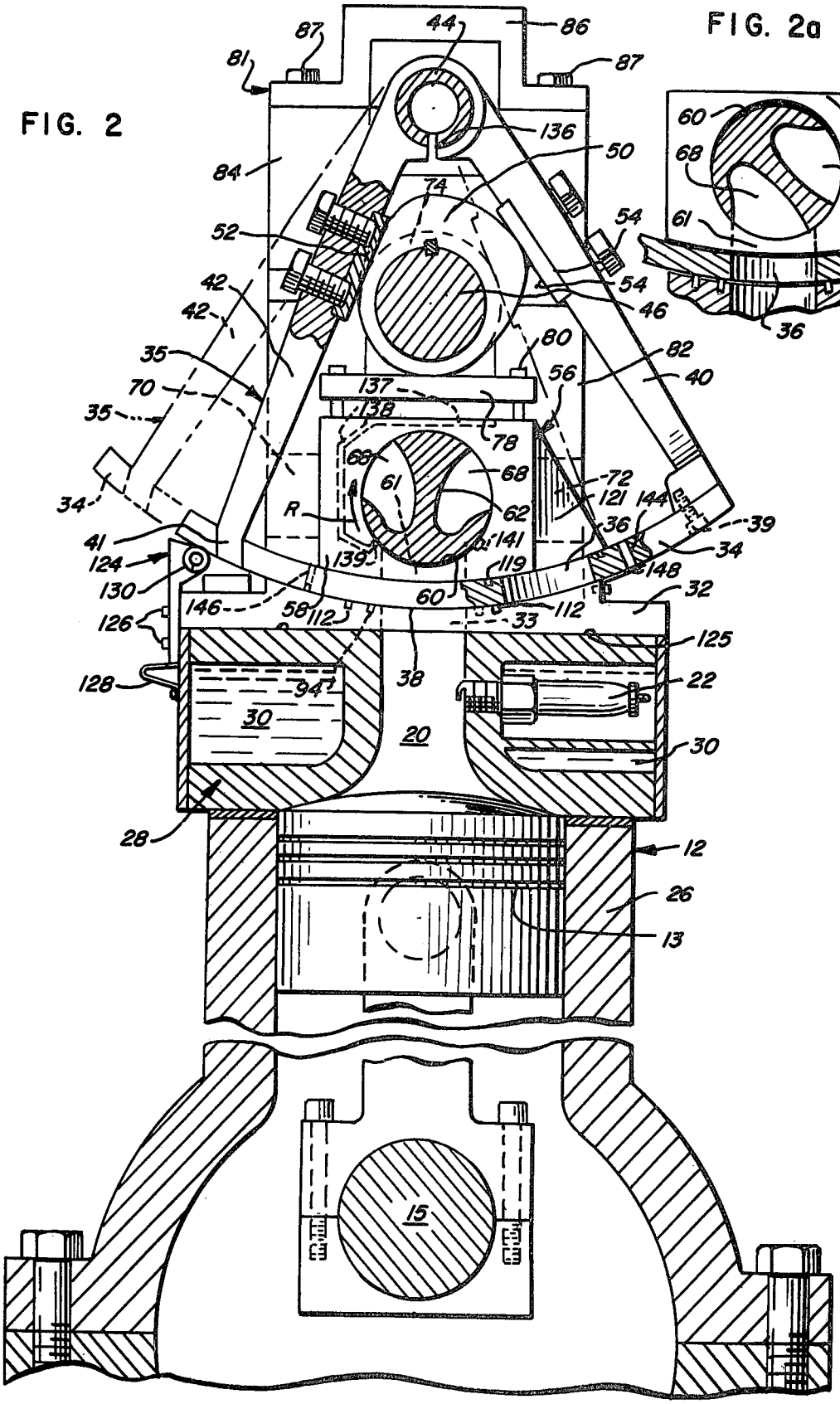

Valve plate 34 defines an aperture 36, which is positioned to be in registry with aperture 33 and neck portion 20 in a first rocking position of valve plate 34 (as in FIG. 2*a*), and to be out of registry with aperture 33 and neck portion 20 in a second rocking position, as shown in FIG. 2, so that an unbroken sealing surface 38 is positioned across the open top of neck portion 20. This latter position permits obstruction of fluid communication into or out of the combustion chamber, and acts to seal it during the compression and combustion phases of the engine.

Valve plate 34 is attached at one end to rocker arm 40 by bolts 39 or the like, and is slidingly retained at its other end by prings 41 of rocker arm 42, in a manner to permit a slight amount of bending axial motion of valve plate 34, relative to arm 42.

Rocker arms 40, 42 are pivotally attached to pivot shaft 44, serving as fulcrum for their rocking motion. Camshaft 46 is positioned between arms 40, 42, and carries cams 48, 50 (see FIG. 4) which bear respectively against bearing members 52, 54, which are carried respectively by arms 42, 40. Accordingly, as camshaft 46 rotates, cams 48, 50 are positioned to cause arms 40, 42, and valve plate 34, to reciprocate back and forth with rocking motion, with a positive desmodromic action which is preferably governed solely by the rotational position of the camshaft, and not by springs or the like. Hence, the abovementioned first rocking position, where aperture 36 is aligned with neck portion 20, is brought about by one rotational position of camshaft 46, and the second rocking position by another camshaft rotational position.

Each rotary valve assembly 56 comprises a valve block 58, one for each piston and cylinder assembly 12, each defining an aperture 60, through which rotary valve member 62 passes, plus a bottom aperture 61 for communication with aperture 36 in the first rocking position.

In this particular embodiment, rotary valve rod member 62 is defined by a single rod, terminating with a gear 64, passing through all of the valve blocks 58. Gear 64 meshes with terminal gear 65, mounted on camshaft 46, so that the rotation of valve rod member 62 is also controlled by and synchronized with the rotation of camshaft 46. Cog pulley 67 is also attached to camshaft 46 for rotation thereof, and is driven by cog belt 69, which in turn is driven by rotating crankshaft 15.

Valve rod member 62 defines, as shown in FIG. 1, a series of inlet ports 66 for passing fuel vapors to the piston and cylinder assemblies 12, and a series of exhaust ports 68, for carrying exhaust gas away from the cylinders in the exhaust stroke of the piston. An inlet port 66 and an exhaust port 68 are each provided for each valve block 58 and are positioned to communicate through bottom aperture 61, in the first rocking position, with neck portion 20 of the combustion chamber, when valve rod member 62 is in a predetermined rotational position.

Each inlet port 66 and exhaust port 68 leads longitudinally along valve rod member 62, being enclosed within the valve rod member, breaking at both ends through the sides of the valve rod member. Ends 66*e* of the inlet ports and ends 68*e* of the outlet ports are shown in FIG. 1. Ends 66*e*, 68*e* of each inlet and exhaust port occupy longitudinally displaced positions along valve rod 62, which positions are also circumferentially spaced as well as longitudinally spaced on valve rod 62. One of the ends of ports 66, 68 communicate with aperture 61 in various, predetermined rotational positions of valve rod 62.

The degree of circumferential spacing of the respective ends of ports 66, 68 can be defined by an angle of about 90°, as shown in FIG. 1, but other circumferential spacings can be used as desired.

The other set of ends of ports 66, 68, which are longitudinally spaced from apertures 61, communicate respectively with fuel inlet ports 70 and exhaust manifold ports 72, when valve rod member 62 occupies a rotational position permitting communication of the other end of the respective port through bottom aperture 61 into neck portion 20. Inlet ports 66 communicate in this circumstance with their associated inlet manifold ports 70. Exhaust ports 68 communicate with their associated exhaust manifold ports 72. While this takes place, valve plate 34 will occupy its first rocking position.

As valve member 62 rotates in registry with the rotating camshaft 46, cams 48 and 50 are adjusted to cause each set of rocker arms 40 and 42 to place aperture 36 of valve plate 34 into the first rocking position, that is: registry with neck portion 20 of the combustion chamber 12, at the same time that each inlet port 66 assumes a rotational position to permit communication between each combustion chamber 12, through the inlet port 66, to the inlet manifold port 70. Aperture 36 remains in registry with neck portion 20 while valve member 62 rotates into another rotational position to permit communication from the combustion chamber through exhaust port 68 to exhaust manifold port 72. This situation occurs during the intake and exhaust cycles of operation.

In another part of the cycle of operation of the engine, camshaft 46 causes arms 40, 42 to move aperture 36 away from neck portion 20 to the second rocking position, specifically during the compression and combustion cycles of operation. Correspondingly, the inlet and exhaust ports 66, 68 are generally not in a position of registry with bottom aperture 61 at this time of the operation.

Also, during the compression and combustion phases of the cycle of operation of the motor of this invention, additional camms 74, 76, mounted on camshaft 46, press against an adjustable-height frame 78, attached to valve block 58. The action of cams 74, 76 depresses valve block 58 against valve plate 34, in its second rocking position, to provide reinforcing sealing pressure of valve plate 34 against bed 32 during the compression and combustion phases of the motor operation.

Figure 4:
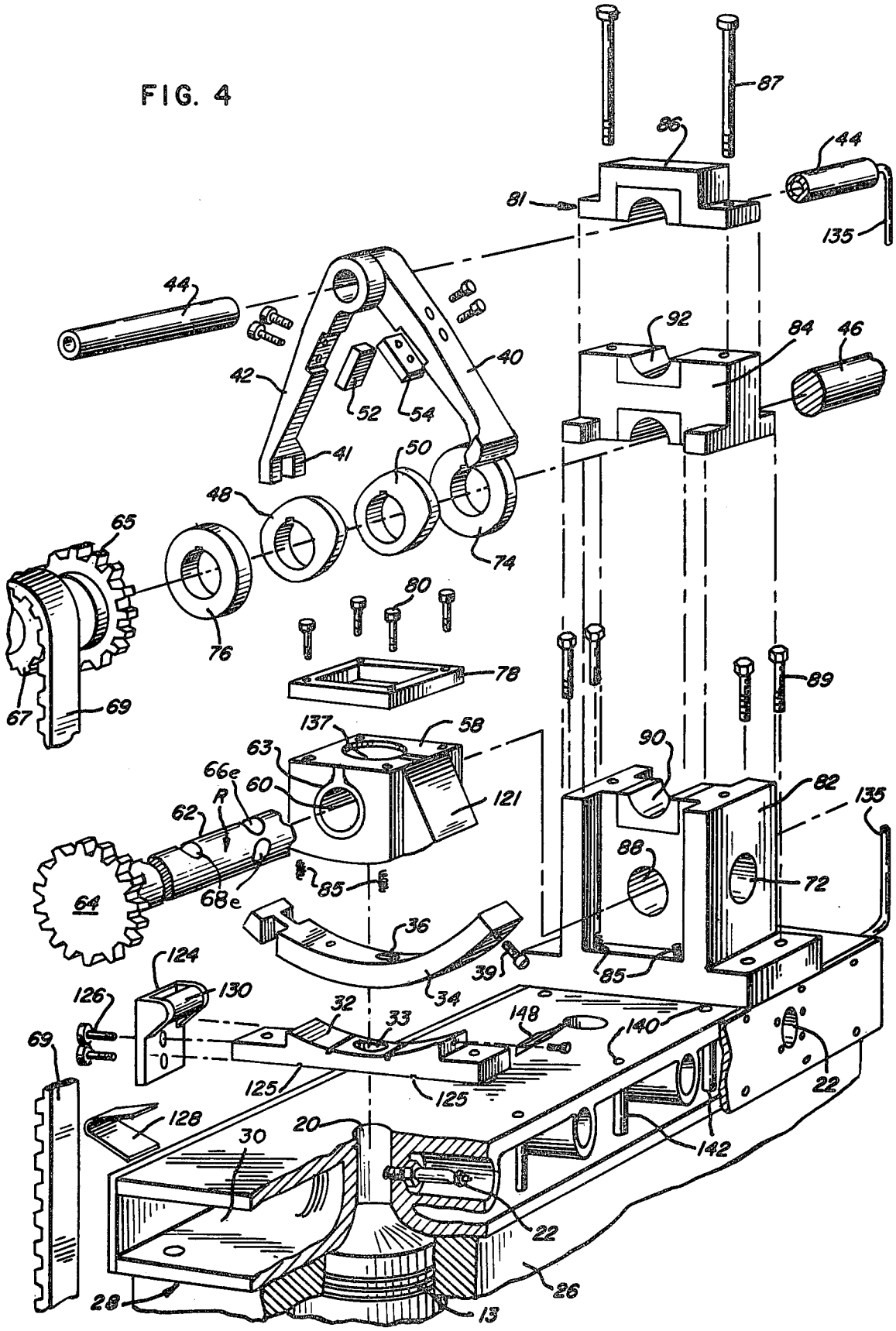
FIG. 4 is an exploded perspective view of one valving and sealing system for a single piston and cylinder of the motor of FIGS. 1 through 3, and also showing related structural parts.

Cams 48, 50 are proportioned to prevent rocking movement of arms 40, 42 during this phase. After the combustion stroke is complete, further rotation of camshaft 46 causes cams 74, 76 to release the pressure on frame 78, allowing block 58 to rise as in FIG. 2*a*, impelled by springs 85, mounted on pillow blocks 81 as shown in FIG. 4.

The amount of motion imparted by cams 74, 76 to block 58, to move the block into engagement with the valve plate 34, may preferably be a total distance of only about 0.01 to 0.03 inch, for example about 0.015 inch, for mimimal expenditure of energy.

Figure 2A:
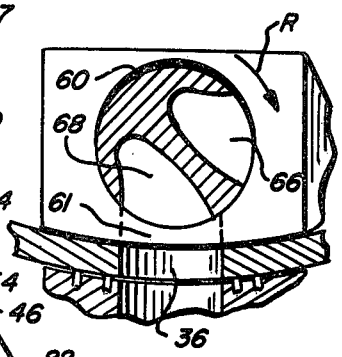

Aperture 60 in block 58 is made slightly oval, as shown in FIGS. 2 and 2*a*, to accomodate the up and down motion of block 58 without requiring corresponding up and down motion of valve member 62.

The ends of each aperture 60 may be conventionally sealed with shaft seals 63 or the like, positioned about valve rod 62, to block any low pressure leakage from the ends of aperture 60.

Adjustable-height separate plate member or frame 78 is carried by bolts or set screws 80, which are set in valve block 58. The purpose of frame 78 is to permit vertical adjustment of the position of valve block 58 against valve plate 34 to the desired amount, and to provide a means for adjustment to suit the individual requirements of the engine, as well as to permit adjustment as the engine wears.

Each valve assembly 35 of valve block 58, arms 40, 42, and the like is separated from its adjacent assembly by a pillow block assembly 81, comprising a set of pillow block members 82, 84, 86. Block members 82, 84, 86 define apertures 88, 90, 92 to receive, respectively, valve rod member 62, camshaft 46, and pivotal shaft 44. Also, the pillow block members 82 (as illustrated in FIG. 3) each define an inlet manifold port 70 or an exhaust manifold port 72, for communication with a section of valve rod member 62, within the pillow block member, which defines one end of an inlet port 66 or an exhaust port 68.

Figure 3:
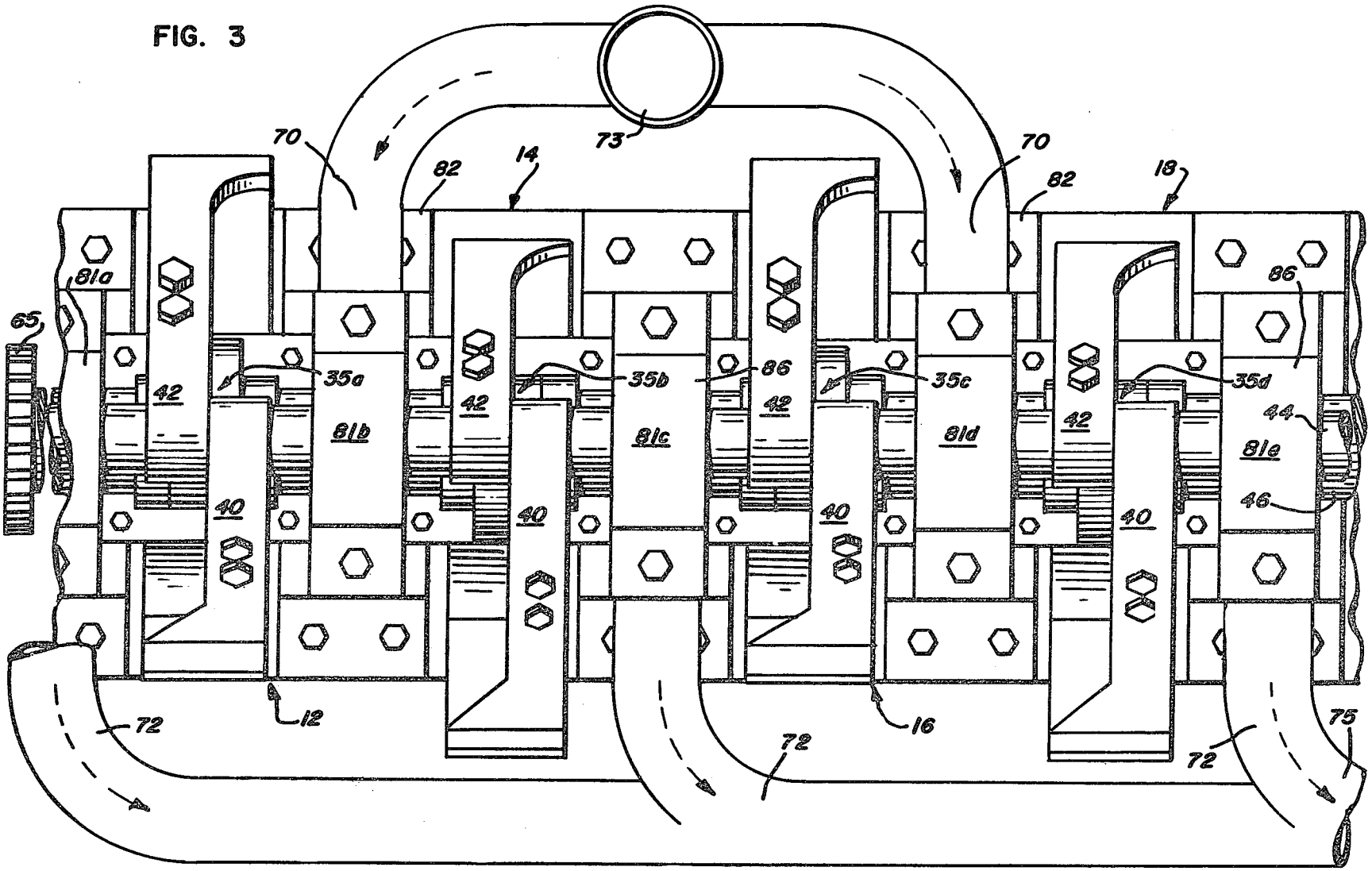
FIG. 3 is a top plan view of the motor of FIGS. 1 and 2.

It will be noted in FIG. 3 that various arms of both inlet manifold port 70 and exhaust manifold port 72 serve two piston and cylinder assemblies 12 and their associated valve assemblies 35. This is accomplished by having the associated inlet ports 66 of two adjacent valve assemblies 35 lead to the same inlet manifold port 70. Correspondingly, the exhaust ports 68 of two adjacent valve assemblies 35 lead to the same exhaust manifold port 72.

Specifically, exhaust port 68 of valve assembly 35*a* leads to the exhaust manifold port 72 of pillow block 81*a*, while the corresponding inlet port 66 leads to an inlet manifold port 70 in pillow block 81*b*. The exhaust port 68 for valve assembly 35*b* leads to exhaust manifold port 72 in pillow block 81*c*, while its inlet port 66 leads to the inlet manifold port 70 in pillow block 81*b*. The exhaust port 68 of valve assembly 35*c* leads to exhaust manifold port 72 in pillow block 81*c*, while its inlet port 66 leads to inlet manifold port 70 of pillow block 81*d*. The exhaust port 68 of valve assembly 35*d* leads to exhaust manifold port 72 in pillow block 81*e*, while its inlet port leads to inlet manifold port 70 in pillow block 81*d*.

Other arrangements of exhaust and inlet manifold system can, of course, also be utilized as desired by the user. However one will note that the inlet manifold system shown in desirably symmetrical in shape, and thus provides an essentially equal flow of fuel vapors to each system and cylinder assembly 12.

Fuel inlet 73 leads to inlet manifold ports 70 from the carburetor, while exhaust outlet 75 leads to the muffler, if any, and then to the exterior.

The construction of pillow blocks 81*a* through *e* is illustrated by pillow block 81 in FIG. 4, being shown to be held together and attached to block 28 by bolts 87, 89.

An auxiliary sealing system 94 is typically provided in valve plate bed 32, as shown in FIGS. 5 through 9.

An annular groove 96 is positioned about aperture 33 in valve plate bed 32. Split ring 98 is positioned within groove 96, defining a split space 100. Insert 104 fits across space 100 to seal it. Skirt 106 of insert 104 fits under ring 98 in a deepened portion 105 of groove 96, as shown in FIG. 8, which is proportioned to receive skirt 106.

Space 100 permits a small variance of the dimensions of split ring 98, as it moves to a slight degree, and expands and contracts due to temperature changes and dynamic conditions.

Split ring 98 rests upon a corrugated wave ring 108 that serves as a spring member, and defines split 109 of similar dimension to space 100. Corrugated wave strip 111 fits in deepened portion 105 of groove 96, under skirt 106. Accordingly, as valve plate member 34 is pressed down upon bed 32, a focused pressure seal will be created against the underside of valve plate member 34 by split ring 98 and insert 104, while those members will be pushed downwardly into recess 96, against the resisting spring bias action of wave ring 108 and strip 111.

The usual maximum amount of depression or the clearance 110 of members 104, 98 may be on the order of 0.015 inch, similar to the amount of depression of valve block 58 by cams 74, 76. Upon engagement with the valve plate member in stationary sealing relationship in the second rocking position, members 104, 98 will preferably be pushed downwardly to be flush with the surface of valve bed 32, to facilitate the momentary, stationary sealing action during each compression and combustion cycle of the engine.

When valve plate 34 is moving in the intermittent rocking motion described previously, split ring 104 and insert 98 are preferably proportioned to scrape against the underside of plate member 34, to wipe away oil and prevent it from passing into aperture 33.

Similarly, wiper members 112 comprise transverse channels 114, as shown in FIG. 6, containing a floating blade 116, supported by a wave spring member such as corrugated strip 118. Flow channels 120 communicate with transverse channels 122, to allow for the flow of oil wiped by blades 116 transversely through channels 120, 122 to the lower edge of valve plate bed, through exit ports 125. From there, the oil can be collected as desired and recycled to the oil pan in conventional manner, as part of an oil lubrication system which shall be described below.

Wiper assemblies 112 thus exhibit the same biased resilience, with blades 116 typically normally projecting upwardly above the surface of valve bed 32 about 0.015 inch, similarly to split ring 98, to provide further oil sealing action for aperture 33.

For oil sealing of the upper surface of valve plate 34, annular ring 119 is provided about aperture 36, being of construction similar to annular ring sealing system 94 about aperture 33.

Projecting portion 121 of valve block 58 is positioned to overlie in the second rocking position those portions of annular ring 119 which lie beyond the main portion of valve block 58, so that a continuous oil seal is provided about aperture 36.

Resilient spring member 124 is for the purpose of biasing the free end of valve plate 34 upwardly, to lift it off of valve bed 32 as shown in FIG. 2*a* when valve plate 34 is not being biased downwardly through the pressure imparted by valve block 58 and cams 74, 76. This reduces the friction of the rocking motion of valve plate 34 between the first and second rocking positions.

Spring member 124 is slidingly mounted on a pair of pins 126, and is biased upwardly by a spring device 128. Spring member 124 also carries one or more rollers 130 upon which the valve plate member rides.

A specific cycle of operation of piston and cylinder assemblies 12, and their associated valve assemblies 35, is as follows:

As shown in FIG. 2, one piston 13 is illustrated to be in its top dead center position, immediately prior to the ignition phase of the engine cycle. Preferably, the compression ratio of the system is in excess of 10 to 1, for most efficient operation, although lower compression ratios are also effectively useable.

As shown in FIG. 2, valve block 58 is pressing against valve plate 34, impelled by the action of cams 74, 76. In turn, valve plate 34 is pressing against valve bed 32, providing a stationary, high pressure seal against the pressurized fuel vapors in neck portion 20. In particular, a focused pressure seal is created by sealing system 94.

During the operation of the engine, valve rod member 62 and camshaft 46 may be in constant rotary motion. However, cams 48, 50 are proportioned so that, during the compression and ignition phases of the cycle, arms 40, 42 and valve plate 34 are stationary, to provide the desired stationary seal.

Upon actuation of spark plug 22 to create a spark, ignition of the fuel vapors in neck portion 20 takes place, driving piston 13 downwardly, and imparting torque to crankshaft 15 either by conventional means, or means described in detail in my co-pending application cited above. Accordingly, piston 13 advances to the bottom dead center position, at which time the ignition phase of the engine cycle is ended.

Typically, before the end of the ignition phase, (e.g. 70° prior to bottom dead center position) camshaft 46 has rotated sufficiently to cause cams 74, 76 to release their pressure on valve block 58. Accordingly, valve block 58 rises (typically by about 0.015 inch) to release its pressure against valve plate 34, which accordingly also rises approximately a similar distance, assisted by spring member 124.

Typically before bottom dead center position (e.g. 60 degrees before) the further rotation of camshaft 46 causes cam 48 to begin to exert pressure on bearing member 52, driving rocker arms 40 and 42 (which may be separate or connected pieces) to the left as illustrated in FIG. 2, to the first rocking position indicated in dotted lines therein, and more specifically shown in FIG. 2*a*. As described previously, in this position, off center aperture 36 of valve plate 34 enters into registry with aperture 61 and the open top of neck portion 20. Piston 13 begins to be impelled upwardly toward top dead center position again by crankshaft 15.

Also, the associated exhaust port 68 in valve rod member 62 enters into registry with aperture 61, as well as its associated exhaust manifold port 72, so that the upward stroke of piston 13 causes exhaust to be expelled through aperture 36, exhaust port 68, and exhaust manifold port 72.

As the piston 13 reaches top dead center position once again, the continuous rotation of valve rod member 62 within valve block 58 causes inlet port 66 to enter into registry with apertures 61 and 36, with the other end of inlet port 66 coming into registry with the associated inlet manifold port 70. During this period of time, valve plate 34 and rocker arms 40, 42 remain generally stationary, despite the continuing rotation of camshaft 46. This is accomplished by appropriate shaping of cams 48, 50.

Accordingly, new fuel enters neck portion 20 from inlet manifold port 70 through inlet port 66 and apertures 61 and 36, impelled by the suction of piston 13 as it travels once again from top dead center to bottom dead center position in the intake phase of the engine cycle.

Typically after piston 13 reaches bottom dead center position again (e.g. 60° after bottom dead center position) the continuing rotation of camshaft 46 causes cam 50 to begin to exert pressure against bearing member 54, causing rocker arms 40, 42 and valve plate 34 to abruptly shift once again to the second rocking position, in which aperture 36 is no longer in registry with aperture 61 and neck portion 20.

As piston 13 rises again in the compression phase of the motor's cycle of operation, cams 74, 76 once again depress block 58, to once again force valve plate 34 into sealing engagement with bed 32. Rocker arms 40, 42 and valve plate 34, as stated before, remain stationary during the sealing phase. Piston 13 continues to rise to top dead center position, at which point maximum compression of the fuel is achieved. Then, at an appropriate time, spark plug 22 ignites the fuel mixture.

Typically, valve rod member 62 rotates once every complete engine cycle.

The design of this invention reduces the possibility of "hot spots" in the engine, avoiding a preignition site for the fuel prior to the appropriate time of ignition as dictated by spark plug 22. Thus, the motor can operate with lower octane fuel and at a higher compression ratio without encountering as great a danger of preignition as is found in conventional motors.

Each of the valve systems 35*a, b, c,* and *d* operate in the aforesaid manner, but the respective inlet ports 66 and outlet ports 68 are positioned on valve rod member 62 so that the cycles of operation of each respective valve system 35 are displaced in this embodiment by 90° of rotation of the valve rod member 62 from the cycle of operation of the immediately preceeding valve system 35. Valve rod member 62 rotates in direction R.

For each valve block 58, the associated inlet and outlet ports 66, 68 are preferably so arranged that pairs of port ends 66*e*, 68*e* of ports serving the same valve block occupy the same circumferential position on valve rod 62, as shown in FIG. 3. Each pair of ends 66*e*, 68*e* is preferably circumferentially displaced about valve rod 62 by about 90° from the other pair of ends of the same ports.

In one specific mode of operation, when camshaft 46 and valve rod member 62 are in a rotational position so that the valve system 35*a* is just beginning the compression phase; valve system 35*c* is simultaneously beginning the intake phase; valve system 35*d* is simultaneously beginning the exhaust phase; and valve system 35*b* is simultaneously beginning the ignition phase. Inlet ports 66 and exhaust ports 68 of valve rod member 62, as well as cams 48, 50, 74, and 76 may be appropriately positioned to achieve this result, which is as shown in FIG. 1. FIG. 3 shows the engine after 270° of rotation of valve rod member 62 beyond the position of FIG. 1, so that, for example, valve system 35*a* is in the intake phase.

Each valve assembly 35 may be lubricated as follows. Shaft 44 may be hollow, and may be connected to a source of pumped oil such as conduit 135 from the oil pan. Alternatively, conduit 135 may pass through the pillow blocks.

One or more ports 136 are positioned above each set of cams 48, 50, 74, 76 so that oil falls freely on the camshaft, lubricating the bearing surfaces between the cams and bearing members 52, 54, as well as the bearing surfaces of cams 74, 76 against frame 78. From there, the oil spills over block 58 to valve plate 34, to lubricate the surface between block 58 and valve plate 34.

Simultaneously, oil can pass into passage 138 from depression 137 in block 58, to lubricate valve rod member 62 rotating in aperture 60. Scraper blade 139 is provided at the end of passageway 138 where oil is placed on valve rod 62, to prevent oil from passing into aperture 61. Second scraper blade 141 removes excess oil from rotating valve rod 62 to prevent it from passing into aperture 61. The groove in which scraper blade 141 resides may be open to the exterior, so that excess oil spills out from the sides of block 58. Scraper blades 139, 141 may be similar in construction to wiper assemblies 112 described previously.

Oil passes from the top of valve plate 34 through apertures 144, 146 to the underside of valve plate 34. Oil passing through aperture 144 may be collected on strip 148, which may be attached to bed 32 as shown in FIG. 2. Accordingly, as valve plate 34 rocks back and forth on bed 32, oil retained by strip 148, and oil passing through aperture 146, are spread along the junction between plate 34 and bed 32 for lubrication thereof, except where prevented by wiper assemblies 112 and sealing system 94.

Oil collected in channel 114 of wiper assemblies 112 passes out of apertures 125 at the bottom of bed 32, from where the oil can be collected by apertures 140 and conduits 142, through block 28 for recycling to the oil pan.

Accordingly, the present oil system may basically be a gravity feed system for each valve assembly 35.

Other conventional oiling means can be provided for necessary or desired areas, for example, for the lubricaion of rotating members 46 and 62 in the pillow blocks 81, and the like.

The above described apparatus illustrates a valving system which is specifically shown for use in conjunction with a four-cylinder, four-cycle engine, but can be easily adapted for use with engines of any number of cylinders and of any desired firing order, or with other types of engines besides the four-cycle, piston and cylinder engine.

The embodiment of FIGS. 10 through 19 utilizes broadly similar principles of structure and operation to the previous embodiment, except as otherwise indicated herein. The similarity can be particularly noticed by comparing FIGS. 2 and 10.

A conventional piston 150 reciprocates in a cylinder 152 which preferably contains flow channels 154 around the cylinder for providing a flow of cooling water, to lower the operating temperature of the engine. The upper portion of cylinder 156 may, as in the previous embodiment, be constricted to provide the advantages described previously. Constricted portion 156 of the cylinder may also define water flow channels 158 for cooling, and laterally mounted spark plug 160 in a spark plug well as in the previous embodiment.

Rotary valve 162 is provided for a function similar to that previously described. Valve 162 is positioned as previously in valve housing 164 which housing loosely fits about valve 162. Housing 164 defines an aperture in which valve 162 fits, which is of slightly oval shape to permit upward and downward reciprocation of valve block 164 by a distance on the order of, preferably, 0.05 to 0.015 inch.

Rotary valve 162, in turn, defines apertures 168 which communicate, respectively, with intake manifold 170 and exhaust manifold 172 in a conventional manner of operation for rotary valves.

A sliding valve assembly positioned between the opening 157 of constricted cylinder portion 156 of the combustion chamber and valve block 164 is defined by a pair of reciprocating valve plates 174, 176, which serve as a replacement for valve plate 34 in the previous embodiment. Valve plates 174, 176 each define a parallel sealing edge 178, 180 with the valve plates 174, 176 being positioned so that the parallel sealing edges abut each other in sealing relationship when the valve plates 174, 176 are in a first position, as shown in FIGS. 10*a* and 11, to define a sealing surface 182 to close off the upper end 157 of the combustion chamber.

Figure 10:
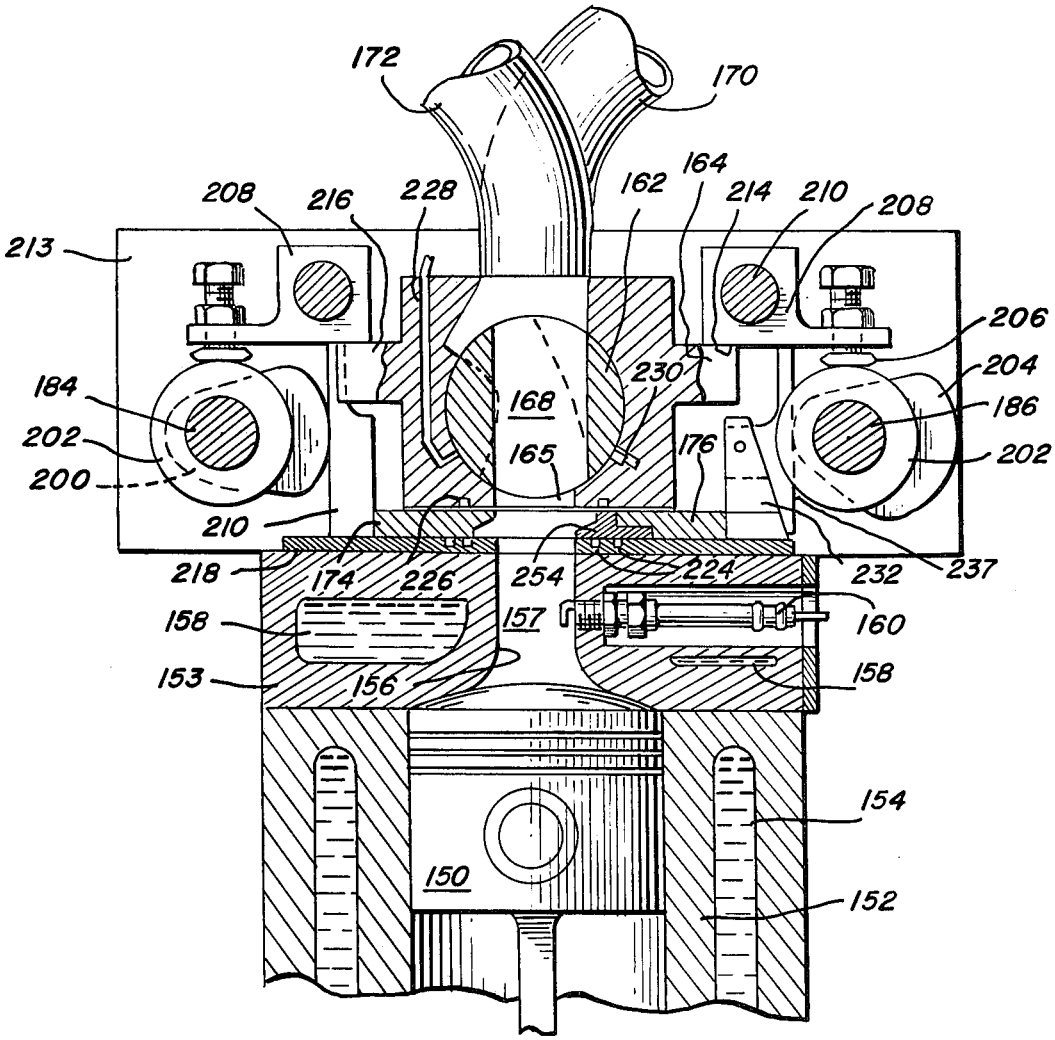
FIG. 10 is a transverse vertical sectional view taken through the second embodiment of the motor as illustrated in FIG. 14 with the valve plates in the open position.
Figure 10A:
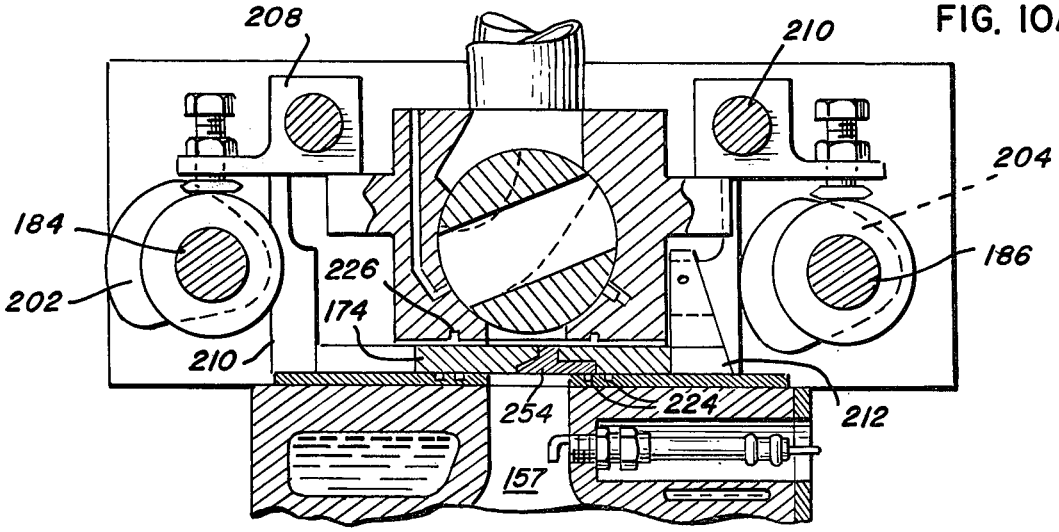
FIG. 10A is a fragmentary sectional view, similar to FIG. 10, but with the valve plates in the closed position.
Figure 12:
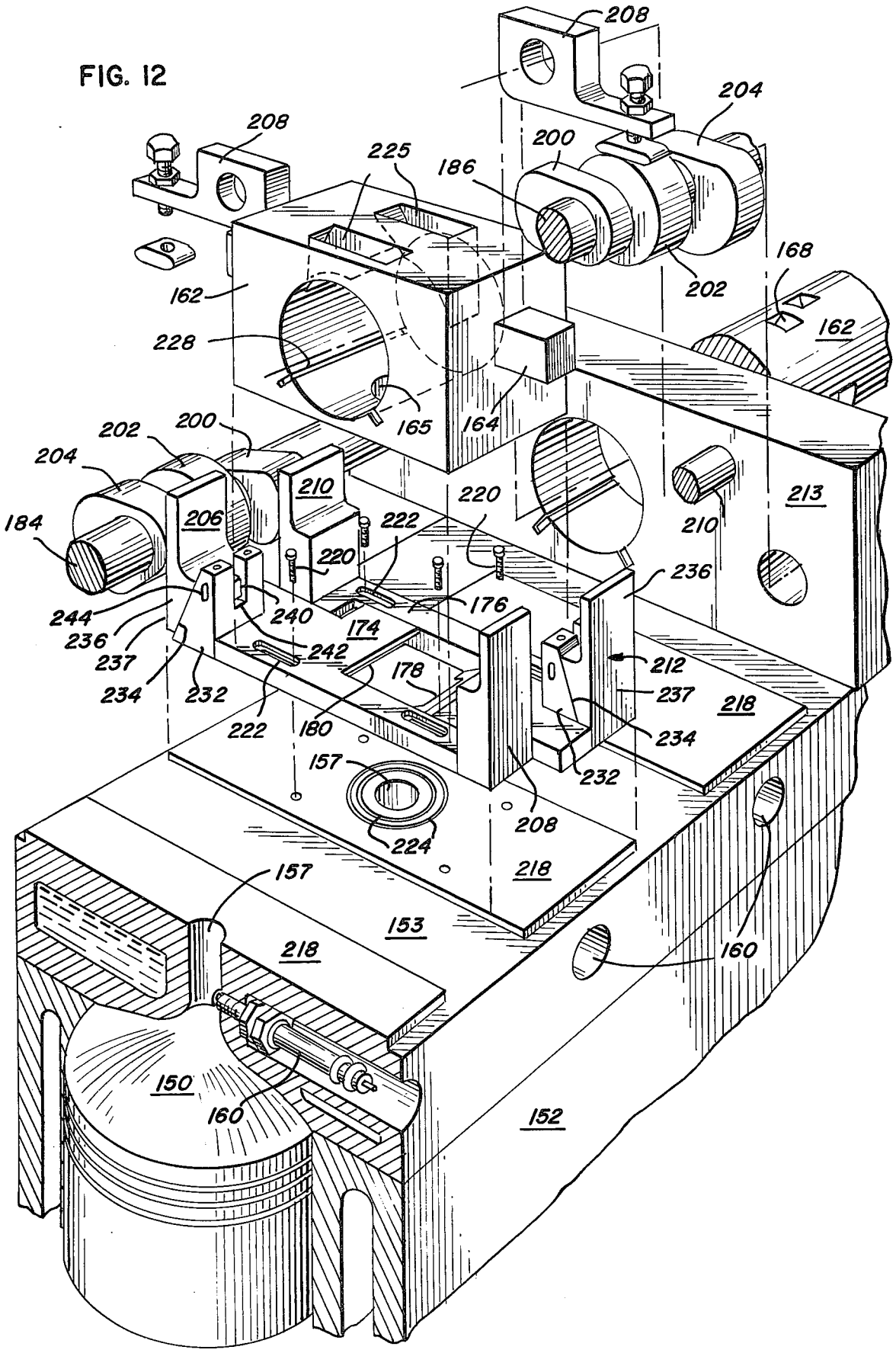
FIG. 12 is an exploded perspective view of the motor of FIGS. 10 to 19.

Valve plates 174, 176 can move in directions opposite to each other into a second position as shown in FIGS. 10 and 12 to define an open aperture through which fuel may be taken in through intake manifold 170 and valve 162, and through which exhaust gas may be expelled through the same rotary valve 162 and exhaust manifold 172.

The motion of valve plates 174, 176 is governed by a pair of rotatable camshafts 184, 186 which are adapted to be in synchronous rotation with valve 162 by belt and pulley system 188, which may be positioned at the front or back of the engine adjacent the ends of the respective shafts. In the embodiment shown, camshafts 184, 186 each carry a pulley 190. Rotary valve 162 also carries a pulley 190. Belt 192 is threaded about the respective pulleys 90 as well as a pulley on crankshaft 194 and two idler pulleys 196, 198. Accordingly, the entire system operates in synchronous rotation, driven by the crankshaft 194.

Each camshaft 184, 186 carries three cams for each cylinder utilized in the motor: cams 200, 202 and 204. Cams 200, 204 respectively bear against cam followers 206, 208, 210 and 212 on the ends respectively of plates 174, 176. In each respective camshaft 184, 186, cams 200, 204 are in reversed position to the corresponding cams on the other camshaft as shown so that each set of cams 200, 204 positioned on opposite camshafts cooperates to push each plate 174, 176 back and forth between the camshafts to open and close the valve aperture between the plates, as the plates move in opposite directions between the first and second positions.

As in the previous embodiment, plates 174, 176 are positioned in their first position during the compression and ignition phases of the motor operation, then moving by the action of opposing sets of cams 200, 204 to the second, open position as shown in FIGS. 10 and 12 for the exhaust and intake phases of the motor operation. Thereafter, cams 200, 204 are proportioned to move plates 174, 176 back into their first, sealing position for a new compression and exhaust phase in the engine cycle.

It can be seen that cams 200, 204 perform a function generally similar to cams 48 and 50 in the previous embodiment, although by a different form of mechanical action.

Cams 202 are also opposed to each other on their respective camshafts, and perform a function which is analogous to cams 74, 76 in the previous embodiment. The cams define an off-center circumference of, preferably about 0.015 inch. Bearing member 206 slides against the periphery of each cam 202, being retained by lever arm 208 which is adapted for pivoting about pivot shaft 210, each of which is mounted in pillow blocks 213 by passing through apertures thereof.

Accordingly, as camshafts 184, 186 rotate, cams 202 are positioned so that their longer radius portion engages bearing member 206 while valve plates 174, 176 are in their first, closed position, during the compression and combustion phases of the engine cycle. Levers 208 are accordingly raised on the side adjacent cams 202, and lowered on sides 214, pressing on ears 216 of block 164 to force valve block 164 downwardly against the closed valve plates 174, 176. This facilitates the sealing of the combustion chamber at its upper end 157, as in the previous embodiment.

When bearing member 206 is elevated by cam action about 0.015 inch, valve block 164 is lowered by approximately 0.005 inch, with about a threefold mechanical advantage, to provide a desired firm pressure against valve plates 174, 176, to prevent leakage of combustion products.

Immediately thereafter, as the shorter radius portion of cam 202 rotates into contact with bearing 206, the downward pressure on valve block 164 by lever arms 208 is released, to allow valve plate members 174, 176 to move from their first to their second positions for opening the combustion chamber, and then to permit the valve plate members to close once again, prior to reapplication of the pressing force of valve block 164 through the action of cams 202.

Valve plate members 174, 176 may be retained on valve plate bed 218 by bolts 220, which are retained in slots 222. Valve plate bed, in turn is carried by the upper surface of the upper cylinder block 153.

Figure 16:
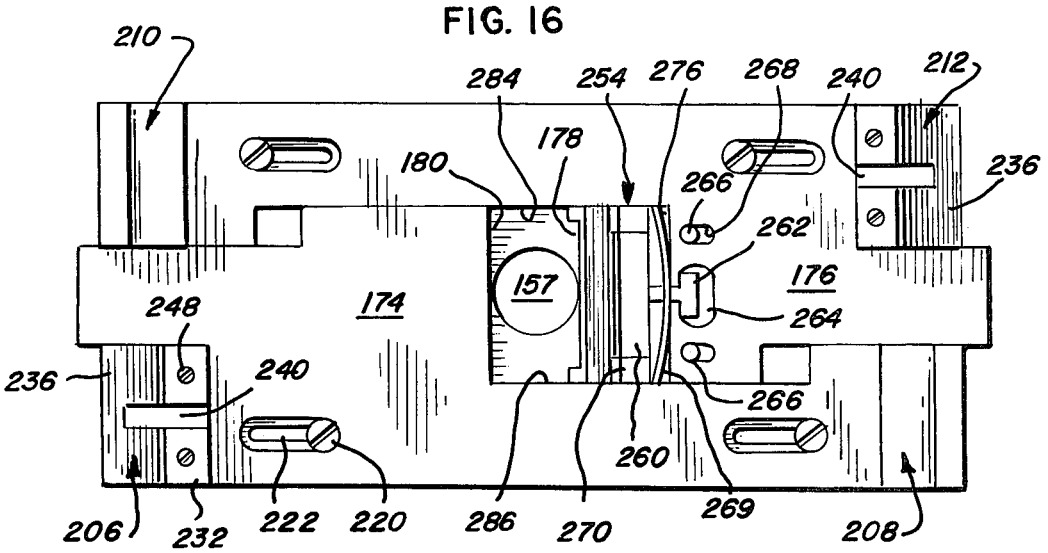
FIG. 16 is a top plan view of the valve plates otherwise shown in FIG. 10.

Slot 222 may have beveled edges as shown in FIG. 16 so that bolts 220 rest flush within the slot.

The upper end of combustion chamber 157 exits through valve plate bed 218, being surrounded by one or more annular seals 224, which may be constructed in the manner of auxiliary sealing system 94 as previously disclosed above.

Figure 13:
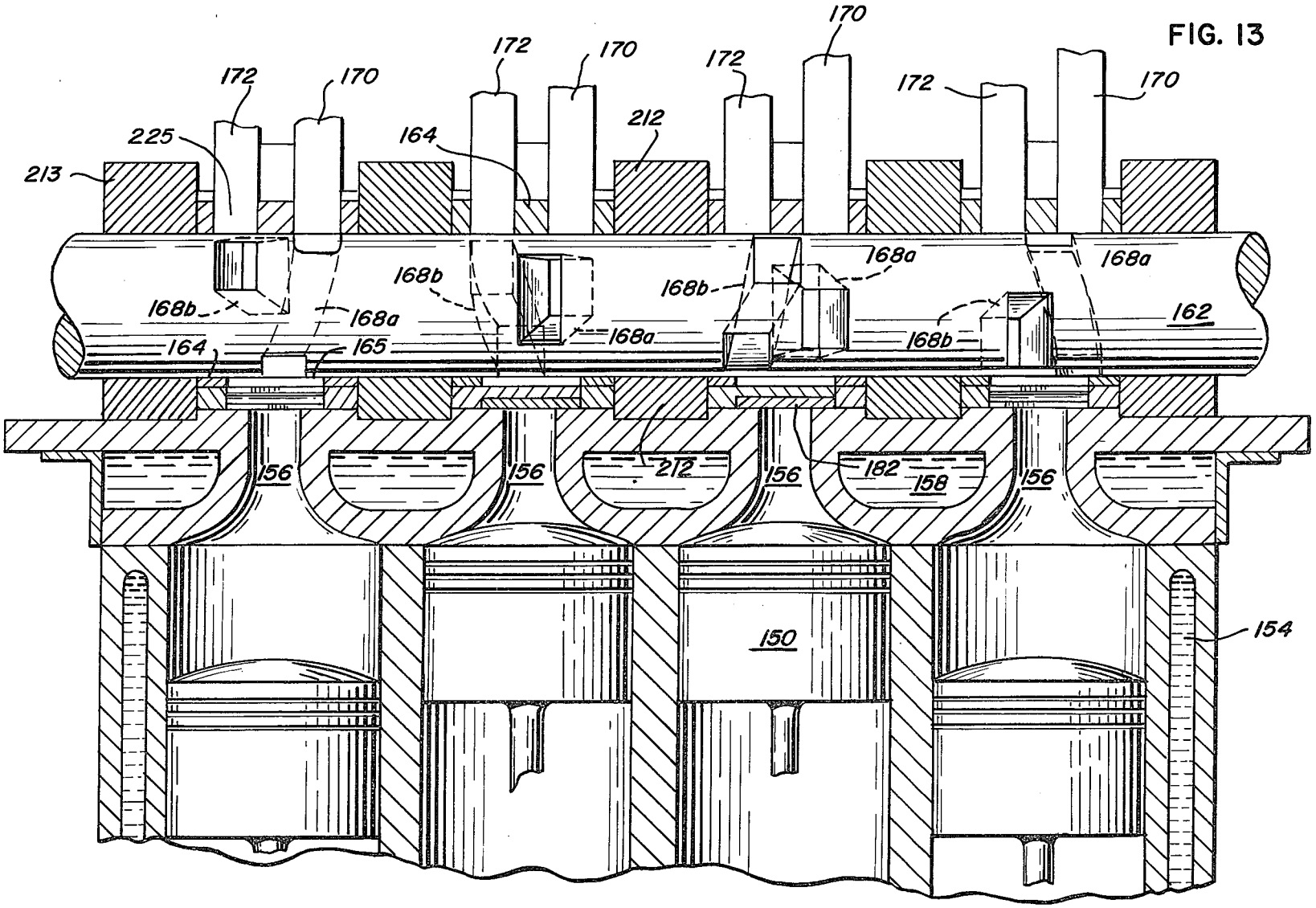
FIG. 13 is a longitudinal vertical sectional view taken on a line perpendicular to the sectional view of FIG. 12.
Figure 14:
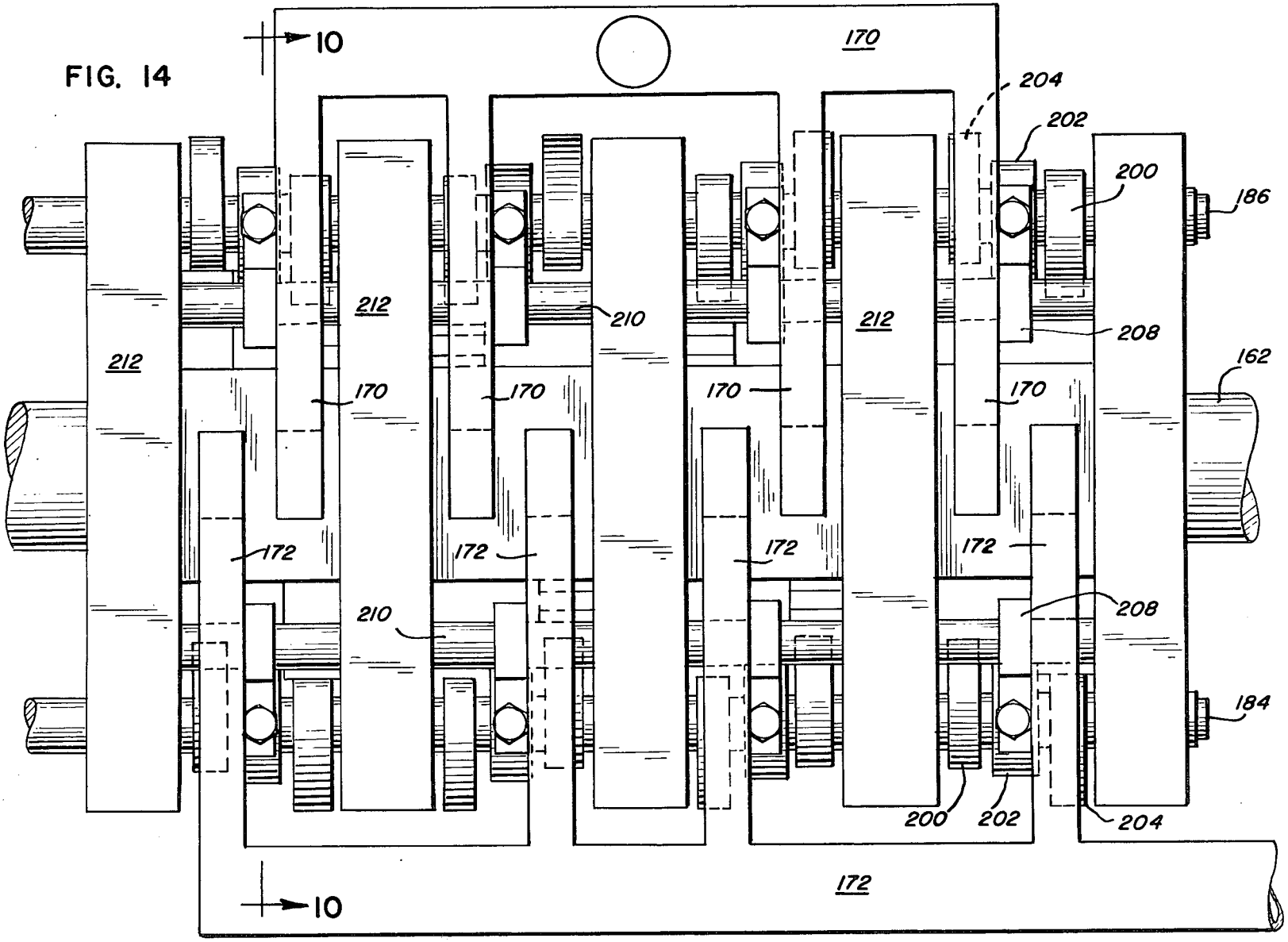
FIG. 14 is a top plan view of FIGS. 10 through 13.

FIG. 13 shows a typical arrangement for the exhaust manifolds 172 and the intake manifolds 170 for a four-cylinder engine utilizing the invention of this application, and having the firing order of the previous engine. The apertures 168*a* on rotary valve 162 which provide access between intake manifolds and cylinder chambers 156 are shown as indicated. Channels 168*b* provide communication between exhaust manifolds 172 and chamber 156, as can be seen. Manifolds 170, 172 communicate with rotary valve rod 162 through apertures 225 in valve block 164. The flow path is then completed through aperture 165 in the bottom of valve block 164.

An upper annular seal 226 is defined in the lower surface of valve block 164 to provide additional sealing of the interface between the valve block and valve plates 174, 176. Seal 226 may be constructed in a manner similar to that of seals 224.

Oil entry port system 228 is similar to the system of the previous embodiment, except that oil line may be pressure-fed in conventional manner. Scraper blade 230 is provided in a manner similar to member 141 in the previous embodiment to remove excess oil from portions of the rotary valve 162 before exposure to combustion chamber 156 (in this embodiment, as in FIG. 10, rotary valve 162 rotates clockwise).

Other conventional oil lubrication systems may be used in the motor of this invention.

As in the previous embodiment, the embodiment of FIGS. 10 through 19 can be lubricated by free-falling lubricant, falling on and around valve block 164 and camshafts 184, 186. By this, the sliding surfaces adjacent and on valve plates 174, 176 can be lubricated as well. Alternatively, more sophisticated pressurized lubrication systems can be provided in any manner desired.

At least one of the cam followers of each sliding valve plate 174, 176 is a multi-part system to permit adjustment of the length of each valve plate 174, 176 to fit the needs of the particular system, to adjust for wear, and the like.

As shown in FIG. 12, each of cam followers 206, 212 comprises an inner member 232 which is attached to its respective plate 174 or 176. Inner member 232 defines an angle other than perpendicular to the plane of the respective plate members 174, 176. An outer member 236 defines a typically flat cam contact surface 237 for contact with its mating cam 204 (or cam 200 as the case may be).

Outer member 236 also defines an inner surface positioned against and parallel to the upstanding end face 234 and correspondingly indicated by that reference numeral as well. Accordingly, movement of outer member 236 upwardly or downwardly along the sliding surfaces 234 correspondingly causes cam contact surface 237 to move inwardly or outwardly to change the overall length of each plate member 174, 176. This permits the adjustment of the plate members by a few thousandths of an inch as necessary to optimize the functioning of the engine.

Figure 17:
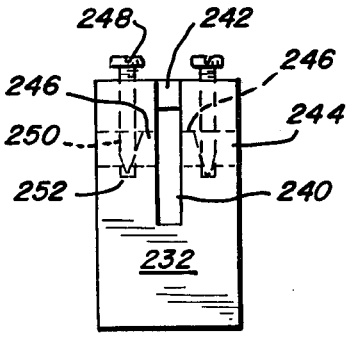
FIG. 17 is a transverse sectional view of a cam follower assembly attached to the valve plates.

FIG. 17 shows the retention mechanism utilized for holding outer member 236 in a fixed position with respect to inner member 232. Outer member 236 defines a projection 240 which fits in slot 242 of inner member 232. Inner member 232 also defines a side port 244 which passes through slot or aperture 242. Positioned within side port 244 are a pair of gripping pads 246, positioned to bear against and grip projection 240, impelled by the pressure of tapered bolts 248. The tapered surfaces 250 of bolts 248 drive pads 246 inwardly against projection 242 as bolts 248 are advanced into bolt holes 252, for retention of outer member 236.

To facilitate the sealing between edges 178, 180, one of the parallel sealing edges 178 is defined by a sliding member assembly 254. Assembly 254 comprises a first sliding member 256, as part of plate member 176, and having a forward edge 258. A second sliding member 260 is carried by the first sliding member and defines sealing edge 178, adapted for sealing contact with the other sealing edge 180 of plate member 164. The second sliding member is relatively movable in the direction of motion between the first and second positions of plates 174, 176, being retained in plate 176 by the loose fitting of retainer lug 262 of upper sliding member 260 in enlarged aperture 264 of plate member 176.

Pins 266 are carried by lower member 256, and are positioned in slots 268 of sliding valve plate 176 for retention of lower member 256 with valve plate 176.

Spring seals 269 are provided, comprising an arcuate spring member terminated at its ends with enlarged sealing members 270, and positioned at the rear of upper member 260. Lower member 256 also carries a similar spring seal member 272, which is terminated with sealing members 274 and positioned at the rear of lower member 256. Spring member 272 is adapted to bear against a lower portion of plate member 176, while spring seal 268 bears against edge 276 of plate member 176.

Figure 19:
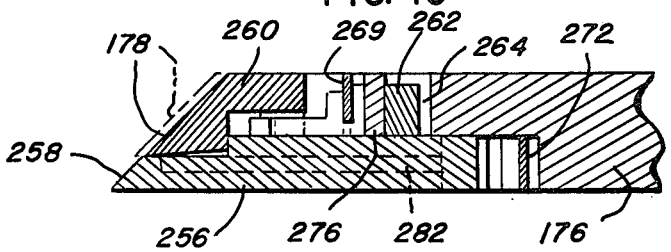
FIG. 19 is a sectional view taken along line 19—19 of FIG. 18.

Accordingly, when the valve plate members 174, 176 are being moved in opposite directions into the first, sealed position where edges 178 and 180 mate together in a sealed closure over the upper end 157 of the combustion chamber, the apparatus is so proportioned that the sliding member assembly 254 is pushed into closed position with edge 180 through projection 262 and related parts, to cause the second sliding member 260 to move relatively forwardly with respect to the first sliding member 356, to cause edge 178 to project slightly forwardly of edge 258, as shown in dotted lines in FIG. 19. This projecting edge forms the seal with edge 180.

Simultaneously, the same closing action causes plates 176 to bear against spring seals 269, 272, correspondingly causing sealing projections 270, 274 to spread outwardly to a slight degree, providing a side seal for sliding member assembly 254 in the first position of the sliding members. As camshafts 184, 186 continue to rotate, and plates 174, 176 begin to move to the open position, the pressure on spring seals 269, 272 is released, causing the side seals 270, 274 to retract laterally inwardly, releasing the side seals. Then, as valve plates 174, 176 begin to move in opposite directions to each other from the first sealing position into the second, open position, projection 262 is pulled by the walls of aperture 264 in plate 176 to cause the entire sliding member assembly 254 to move away from the opening 157 of the combustion chamber. As an initial motion, first sliding member 260 is withdrawn to its position shown in full lines in FIG. 19, shielding the edge 178 from the full effects of the blast of exhaust gas being emitted through the open end of combustion chamber 157.

This process repeats itself over and over again throughout the movement of valve plates 174, 176, to provide a significant increase in the sealing capability of the motor of this invention over conventional valve systems.

Figure 18:
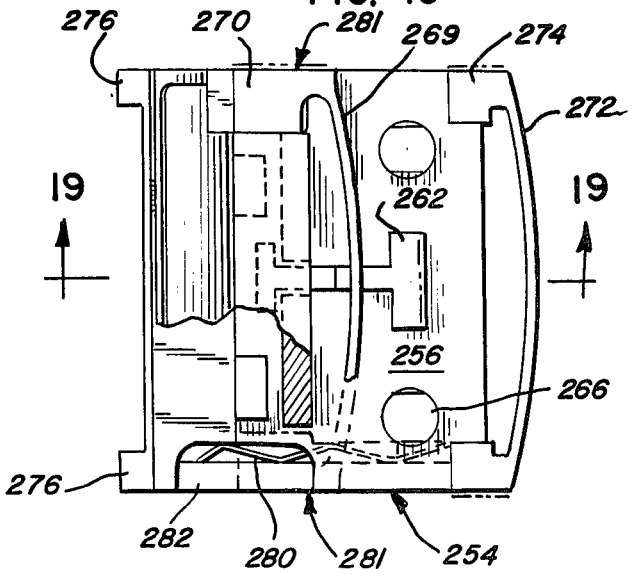
FIG. 18 is an enlarged plan view, with parts broken away, of part of a plate member as shown in FIG. 16.

Additional sealing features of sliding member assembly 254 include projections 276 on first or lower sliding member 256, as well as side seals 281 on both sides of first sliding member 256, one of which is illustrated in FIG. 18 by broken away portions and phantom lines. A wave spring 280 is positioned in a slot behind a flat seal bar 282 which, in turn bears, against side edges 284, 286 of valve plates 174, 176 for sealing.

By means of the above embodiments of a sealing system, rotary valves can be utilized on a long-term commercial and reliable basis. As a result of this, the operating temperature of the engine can be drastically reduced, which, in turn, greatly reduces the amount of nitrogen oxide pollutants produced by the engine. Similarly, engines utilizing the invention disclosed herein can exhibit a great deal of power for their size, coupled with a good "drivability" since, by the use of rotary valves, valve overlap can be minimized. Rotary valves inherently provide much greater efficiency of intake and exhaust than poppet valves, since there is no poppet to impede the flow into and out of the combustion chamber. Also, the engine is expected to operate more efficiently, using low octane fuel if desired.

The above has been offered for illustrative purposes only, and is not for the purpose of limiting the scope of the invention of this application, which is as defined in the claims below.

That which is claimed is:

1. In a rotary valve system for a motor and the like, including a flow conduit terminating in a combustion chamber, and a rotary valve for metering fuel flow through said flow conduit, the improvement comprising, in combination:

a pair of rotatable camshafts positioned on opposite sides of said flow conduit, means for causing synchronous rotation of said camshafts in a manner correlating with the rotation of said rotary valve;

valve plate member means positioned between said camshafts, said plate member means being transversely movable relative to said flow conduit to define a sealing surface across said flow conduit in a first position, and to define an open aperture across said flow conduit in a second position; and cam means on each camshaft in communication with said plate member means to cause said plate member means to respectively move between said first and second positions as said camshafts rotate.

2. The rotary valve system of claim 1 in which said plate member means is positioned between said rotary valve and said combustion chamber.

3. The rotary valve system of claim 2 in which said valve plate member means define first and second, laterally positioned plate members, said plate members each defining a parallel sealing edge, said plate members being positioned whereby said parallel sealing edges abut each other is sealing relationship to define said sealing surface in the first position, and said sealing edges are spaced from each other to define the open aperture in said second position, said cam means being adapted to move said plate members in opposite directions to each other between said first and second position.

4. The rotary valve system of claim 3 in which a single flow conduit communicates with said combustion chamber.

5. The rotary valve system of claim 4 in which said combustion chamber is surrounded by water jacket means to reduce the operating temperature within said combustion chamber.

6. The rotary valve system of claim 5 in which one of said parallel sealing edges is defined by a sliding member assembly which comprises a first sliding member as part of one of said plate members and having a forward edge, and a second sliding member carried by said first sliding member and defining said one sealing edge, adapted for sealing contact with the other sealing edge of the other plate member, said second sliding member being relatively movable in the direction of motion between said first and second positions, and means for causing said one sealing edge to project outwardly beyond the forward edge of said first sliding member in said first position, while causing said one sealing edge to retract rearwardly in back of the forward edge of said first sliding member while moving from said first position to said second position, whereby the one sealing edge is protected from the direct blast of exhaust gas upon opening the seal defined between the plate members.

7. The rotary valve system of claim 6 in which said second sliding member carries, on its side opposite to said one sealing edge, an arcuate, flexible spring member to resiliently bear against an edge of the plate member which carries said second sliding member, to resiliently urge said second sliding member to a forward position, said spring member carrying enlarged sealing members at its respective ends, said ends being positioned at the sides of said second sliding member to be urged outwardly for sealing as said arcuate spring member is compressed, as said first and second plate members move into the sealed, first position.

8. The rotary valve system of claim 7 in which said first sliding member carries on its side opposite to said forward edge an arcuate, flexible spring member to resiliently bear against an edge of the plate member which carries said second sliding member, to resiliently urge said first sliding member to a forward position, said spring member carrying enlarged sealing members at its respective ends, said ends being positioned at the sides of said first sliding member, to be urged outwardly for sealing as said arcuate spring member is compressed as the first and second plate members move into said sealed first position.

9. The rotary valve system of claim 7 in which a movable valve block is positioned about said rotary valve, second cam means positioned on said camshafts, and lever arm means, actuated by said second cam means, adapted for intermittently pushing said valve block against said plate members, while in said first position, to facilitate the sealing of said flow conduit.

10. The rotary valve system of claim 9 in which said valve block defines a pair of oppositely-disposed ears against which said lever arms press.

11. The rotary valve system of claim 10 in which said plate members define upstanding cam follower members positioned at each end thereof, at least one of said follower members of each plate member comprising an inner member defining an upstanding end face which is other than perpendicular to the plane of said plate member, and an outer member defining a cam contact surface and an inner surface positioned against and parallel to the upstanding end face, whereby adjustment of said outer member by movement along said upstanding end face results in a change in the length of said plate member, and means for releasably holding said outer member in immovable position on said inner member.

12. The rotary valve system of claim 11 in which said inner member defines an aperture and said outer member carries a projection, positioned within said aperture; a side port positioned in said inner member communicating with said aperture; and pressure gripping means extending through said side port to engage and rigidly hold the projection within the aperture.

13. In a rotary valve system for a motor and the like, including a flow conduit terminating in a combustion chamber, and a rotary valve for metering fuel flow through said flow conduit, the improvement comprising, in combination: a pair of rotatable camshafts positioned on opposite sides of said flow conduit, in a manner correlating with the rotation of said valve;

valve member means defining first and second, laterally positioned plate members, said plate members each defining a parallel sealing edge, said plate members being positioned whereby said parallel sealing edges abut each other in sealing relationship, said plate members being transversely movable in opposite directions, actuated by the camshafts, relative to said flow conduit whereby said parallel sealing edges can abut each other in sealing relationship to define a sealing surface across said flow conduit in a first position, and said parallel sealing edges can be spaced from each other to define an open aperture across said flow conduit in a second position, and cam means on each camshaft in communication with said plate members to cause said plate member means to respectively move in opposite directions from each other between said first and second positions as said camshafts rotate, said plate member means being positioned between the rotary valve and the combustion chamber; in which one of said parallel sealing edges is defined by a sliding member assembly which comprises a first sliding member as part of one of said plate members and having a forward edge, and a second sliding member carried by said first sliding member and defining said one sealing edge, adapted for sealing contact with the other sealing edge of the other plate member, said second sliding member being relatively movable in the direction of motion between said first and second positions, and means for causing said one sealing edge to project outwardly beyond the forward edge of said first sliding member in said first position, while causing said one sealing edge to retract rearwardly in back of the forward edge of said first sliding member while moving from said first position to said second position, whereby the one sealing edge is protected from the direct blast of exhaust gas upon opening the seal defined between the plate members.

14. The rotary valve system of claim 13 in which said second sliding member carries, on its side opposite to said one sealing edge, an arcuate, flexible spring member to resiliently bear against an edge of the plate member which carries said second sliding member, to resiliently urge said second sliding member to a forward position, said spring member carrying enlarged sealing members at its respective ends, said ends being positioned at the sides of said second sliding member to be urged outwardly for sealing as said arcuate spring member is compressed, as said first and second plate members move into the sealed, first position.

15. The rotary valve system of claim 7 in which said first sliding member carries on its side opposite to said forward edge an arcuate, flexible spring member to resiliently bear against an edge of the plate member which carries said second sliding member, to resiliently urge said first sliding member to a forward position, said spring member carrying enlarged sealing members at its respective ends, said ends being positioned at the sides of said first sliding member, to be urged outwardly for sealing as said arcuate spring member is compressed as the first and second plate members move into said sealed first position.

16. In a rotary valve system for a motor and the like including a flow conduit terminating in a combustion chamber, and a rotary valve for metering fuel flow through said flow conduit, the improvement comprising, in combination, valve plate member means, said plate member means being transversely movable relative to said flow conduit to define a sealing surface across said flow conduit in a first position, and to define an open aperture across said flow conduit in a second position, said valve plate member means defining first and second plate members, said plate membrs each defining a parallel surface, said plate members being positioned whereby said parallel surfaces abut each other in sealing relationship to define said sealing surface in the first position, and said sealing surfaces being spaced from each other to define the open aperture in said second position, and means for moving said plate members in opposite directions to each other between said first and second positions.

17. The rotary valve system of claim 16 in which one of said parallel sealing edges is defined by a sliding member assembly which comprises a first sliding member as part of one of said plate members and having a forward edge, and a second sliding member carried by said first sliding member and defining said one sealing edge, adapted for sealing contact with the other sealing edge of the other plate member, said second sliding member being relatively movable in the direction of motion between said first and second position, and means for causing said one sealing edge to project outwardly beyond the forward edge of the said first sliding member in said first position, while causing one sealing edge to retract rearwardly in back of the forward edge of said first sliding member while moving from said first position to said second position, whereby the one sealing edge is protected from the direct blast of exhaust gas upon opening the seal defined between the plate members.

18. The rotary valve system of claim 17 in which said second sliding member carries, on its side opposite to said one sealing edge, an arcuate, flexible spring member to resiliently bear against an edge of the plate member which carries said second sliding member, to resiliently urge said second sliding member to a forward position, said spring member carrying enlarged sealing members at its respective ends, said ends being positioned at the sides of said second sliding member to be urged outwardly for sealing as said arcuate spring member is compressed, as said first and second plate members move into the sealed, first position.

19. The rotary valve system of claim 17 in which said first sliding member carries on its side opposite to said forward edge an arcuate, flexible spring member to resiliently bear against an edge of the plate member which carries said second sliding member, to resiliently urge said first sliding member to a forward position, said spring member carrying enlarged sealing members at its respective ends, said ends being positioned at the sides of said first sliding member, to be urged outwardly for sealing as said arcuate spring member is compressed as the first and second plate members move into said sealed first position.

20. The rotary system of claim 17 in which a movable valve block is positioned about said rotary valve, and adjacent said plate members, and means for intermittently pushing said valve block against the plate members, while in said first position, to facilitate the sealing of said flow conduit.

21. The rotary valve system of claim 20 in which said valve block defines a pair of oppositely-disposed ears against which said lever arms press.

22. The rotary valve system of claim 21 in which said plate members are moved between their first and second sliding positions by cam means, said cam means being adapted for synchronous rotation in a manner correlating with the rotation of said rotary valve.

23. The rotary valve system of claim 22 in which a movable valve block is positioned about said rotary valve, second cam means positioned on said camshafts, and lever arm means, actuated by said second cam means, adapted for intermittently pushing said valve block against said plate members, while in said first position, to facilitate the sealing of said flow conduit.

24. The rotary valve system of claim 23 in which said valve block defines a pair of oppositely-disposed ears against which said lever arms press.

25. The rotary valve system of claim 24 in which a single flow conduit communicates with said combustion chamber.

* * * * *